US011717077B2

(12) United States Patent
Dowdle et al.

(10) Patent No.: US 11,717,077 B2
(45) Date of Patent: Aug. 8, 2023

(54) ADJUSTABLE AND COLLAPSIBLE DESK

(71) Applicants: Colin Andrew Dowdle, Northfield, IL (US); James Charles Dowdle, Northfield, IL (US); Curtis Leroy Cruver, IV, Elmhurst, IL (US); Stephen Andrew Derfiny, Park Ridge, IL (US)

(72) Inventors: Colin Andrew Dowdle, Northfield, IL (US); James Charles Dowdle, Northfield, IL (US); Curtis Leroy Cruver, IV, Elmhurst, IL (US); Stephen Andrew Derfiny, Park Ridge, IL (US)

(73) Assignee: LILLIPAD WORK SOLUTIONS INC., Greenbay, WI (US)

( * ) Notice: Subject to any disclaimer, the term of this patent is extended or adjusted under 35 U.S.C. 154(b) by 82 days.

(21) Appl. No.: 17/314,747

(22) Filed: May 7, 2021

(65) Prior Publication Data

US 2021/0345768 A1 Nov. 11, 2021

Related U.S. Application Data

(60) Provisional application No. 63/092,635, filed on Oct. 16, 2020, provisional application No. 63/021,823, filed on May 8, 2020.

(51) Int. Cl.

| | |
|---|---|
| ***A47B 3/02*** | (2006.01) |
| ***A47B 21/02*** | (2006.01) |
| ***A47B 9/16*** | (2006.01) |

(52) U.S. Cl.

CPC ..... *A47B 3/02* (2013.01); *A47B 9/16* (2013.01); *A47B 21/02* (2013.01); *A47B 2003/025* (2013.01); *A47B 2200/0058* (2013.01)

(58) Field of Classification Search

CPC ..... A47B 1/03; A47B 21/0314; A47B 21/00; A47B 21/02; A47B 21/03; A47B 9/16;

(Continued)

(56) References Cited

U.S. PATENT DOCUMENTS 6,182,935 B1 * 2/2001 Talesky ..... B23D 47/025 108/118
6,834,450 B2 * 12/2004 Gross ..... D06F 81/10 108/119

(Continued)

FOREIGN PATENT DOCUMENTS

CN 108201228 A 6/2018
CN 209403998 U 9/2019

(Continued)

OTHER PUBLICATIONS

English translation of CN 110367687 (Year: 2019).*

(Continued)

*Primary Examiner* — Janet M Wilkens
(74) *Attorney, Agent, or Firm* — K&L Gates LLP

(57) ABSTRACT

Height-adjustable standing/sitting desks, capable of being easily collapsed, via pivotable legs, to be easily stored away in common and unique spaces throughout a home may include a desktop, a support frame disposed underneath the desktop, a plurality of legs, and an actuator. The plurality of legs is coupled to the support frame. Each of the plurality of legs includes a plurality of integrated wheels. The actuator is disposed within the support frame and coupled to one or more of the plurality of legs. The actuator is configured to raise and lower the desktop.

16 Claims, 9 Drawing Sheets

(58) Field of Classification Search
CPC ..... A47B 9/10; A47B 2021/0321; A47B 2021/0364; A47B 3/02; A47B 3/0809; A47B 3/0815; A47B 2003/025; A47B 3/00; A47B 61/00; A47B 2200/0058; D06F 81/10
USPC ..... 108/20, 147, 144.11, 145, 93, 96, 108/116–120, 43, 138, 50.01, 50.02; 312/223.2, 223.3; 248/421, 562, 588, 248/585, 431, 432, 439, 436; 38/138
See application file for complete search history.

(56) References Cited

U.S. PATENT DOCUMENTS

| | | | | |
|---|---|---|---|---|
| 9,072,645 | B2 * | 7/2015 | Gamman | A61G 7/012 |
| 2006/0070556 | A1 * | 4/2006 | Burton | A47B 31/00 108/77 |
| 2006/0196395 | A1 * | 9/2006 | Lin | A47B 3/08 108/132 |
| 2007/0044350 | A1 * | 3/2007 | Tang | D06F 81/12 38/137 |

FOREIGN PATENT DOCUMENTS

| | | | |
|---|---|---|---|
| CN | 110367687 | * | 10/2019 |
| CN | 110664113 | A | 1/2020 |
| JP | 3079013 | U | 8/2001 |
| KR | 20-2011-0006306 | U | 6/2011 |

OTHER PUBLICATIONS

International Search Report and Written Opinion for related International Application No. PCT/US2021/031338; action dated Aug. 27, 2021; (12 pages).
Preliminary Report on Patentability for related International Application No. PCT/US2021/031338; action dated Nov. 8, 2022; (7 pages).

* cited by examiner

ADJUSTABLE AND COLLAPSIBLE DESK

PRIORITY CLAIM AND CROSS-REFERENCE TO RELATED APPLICATIONS

This application claims priority to and the benefit of U.S. Provisional Patent Application No. 63/021,823, filed May 8, 2020, and U.S. Provisional Patent Application No. 63/092,635, filed Oct. 16, 2020, the entire contents of each of which is hereby incorporated by reference in its entirety and relied upon.

FIELD OF THE INVENTION

The invention disclosed herein generally relates to desks, work-stations, e-gaming desks, and other related furniture primarily for, but not limited to, at-home use.

BACKGROUND

The need for home desks is in high demand, especially in today's environment as work-from-home and e-gaming industries continue to grow. The current market offers two primary solutions: stationary height-adjustable standing/sitting desks and single height stand-alone desks.

Stationary height-adjustable standing/sitting desks have become a desirable tool in today's workplace. Namely, desks with standing features offer improvements to physical health, to posture, and to overall workplace productivity. However, stationary height-adjustable standing/sitting desks require the desk to be located in a dedicated area for long periods of time. There is no easy way to deconstruct, or otherwise relocate, stationary height-adjustable standing/sitting desks, as the desks typically include fixed hardware components such as screws, nuts, bolts, motors, weight, and a general lack of portable features such as handles, wheels, and folding legs. These desks also usually have larger surface areas and require assembly that involves the use of power tools, wrenches, and screwdrivers, for example. Because of these constraints, individuals living in multi-family residences, in smaller apartments, or in homes without a designated office or game room must allocate valuable living space for a stationary desk to remain for extended periods of time.

As an alternative to stationary height-adjustable standing/sitting desks, certain single height stand-alone desks have been developed to include portability features such as vertical shifting table tops or desks legs with caster wheels at each touchpoint (typically four in total). However, users of these desks may experience drawbacks when it comes to workplace efficiency, proper ergonomics posture, comfort, safety and storage of the desk. Specifically, these desks are typically designed with small desktops, no integrated monitor arms, and very little thought with respect to electronics and/or group collaboration. Small desktops lack space for ancillary items such as a keyboard, mouse, laptop, and/or external monitor. The casters typically found on some mobile desks create added risk, as movement may dislodge the desk's position, including any items on the desk itself. Additionally, these desks do not allow for easy transition from a personal desk with a monitor to a sizable table, with no monitor, for group collaboration and meetings. Lacking a structurally sound design, sturdiness, and aesthetics, these desks make it difficult for users to effectively work, or game, for extended periods of time.

Ultimately, the problems identified above served to illustrate a conundrum encountered by consumers when deciding to purchase and implement an at-home standing/sitting desk. The consumer may prioritize workplace productivity and choose the stationary desk while forfeiting valuable living space; alternatively, the consumer may prioritize portability and choose a desk that may be on casters, but not necessarily suitable for long-term use.

Therefore, a need exists for a height-adjustable standing/sitting desk capable of being fully collapsible and portable while simultaneously providing productive work features, such as an integrated monitor arm, durability, and a structurally sound design.

SUMMARY

The present invention is a height-adjustable standing/sitting desk capable of being easily collapsed to be stored away in tight spaces such as a closet, under a bed, under a couch, against a wall, garage, or the like, while retaining its structural durability. The desks disclosed herein value the importance of personal workspace while simultaneously prioritizing interior space constraints, such as those encountered in residences with no dedicated office area.

Focused around workplace productivity, product portability, and no assembly for the end-user, this desk provides the desirable durability and functionality of current stationary standing/sitting desks while maintaining easy-to-use collapsible and storing features. The controllably pivoting legs, the integrated wheels, and the flat-configuration with leg-based handles, all allow users of various sizes and strengths to easily collapse, pivot/lift, and roll the desk to any desirable work or storage location. Individuals who work from home have experienced the benefits of temporarily changing their working location throughout the home for a change in scenery. Thus, this desk generally provides for a productive workplace, as previously non-traditional working areas are transformed into desirable office locations.

This desk may include an integrated monitor mount/arm that allows for convenient monitor storage, when not in use. The integrated monitor mount/arm provides the user with monitor-positioning customization, while ensuring both safety and durability. The integrated monitor arm may be adjusted between a variety of positions, including a "stored" position that removes the integrated monitor arm from the desk surface entirely.

In light of the disclosure herein, and without limiting the scope of the invention in any way, in a first aspect of the present disclosure, which may be combined with any other aspect listed herein unless specified otherwise, a collapsible desk includes a desktop, a support frame, disposed underneath the desktop, a plurality of legs, and an actuator. The plurality of legs is coupled to the support frame. At least one of the plurality of legs includes a plurality of integrated wheels. The actuator is disposed within the support frame and coupled to one or more of the plurality of legs. The actuator is configured to raise and lower the desktop.

In a second aspect of the present disclosure, which may be combined with any other aspect listed herein unless specified otherwise, the plurality of legs includes two legs that are pivotally coupled to one another via a scissor joint.

In a third aspect of the present disclosure, which may be combined with any other aspect listed herein unless specified otherwise, each of the two legs includes a straight portion and a bent portion, the bent portion located at an upper end of each of the two legs.

In a fourth aspect of the present disclosure, which may be combined with any other aspect listed herein unless specified otherwise, the upper end of each of the two legs is configured to translate laterally within the support frame.

In a fifth aspect of the present disclosure, which may be combined with any other aspect listed herein unless specified otherwise, responsive to the upper end of each of the two legs translating laterally within the support frame, the two legs pivot about a pivot component.

In a sixth aspect of the present disclosure, which may be combined with any other aspect listed herein unless specified otherwise, responsive to the upper ends of each of the two legs translating laterally towards each other within the support frame, the desktop is raised.

In a seventh aspect of the present disclosure, which may be combined with any other aspect listed herein unless specified otherwise, responsive to the upper ends of each of the two legs translating laterally away from each other within the support frame, the desktop is lowered.

In an eighth aspect of the present disclosure, which may be combined with any other aspect listed herein unless specified otherwise, when the collapsible desk is lowered to a storage configuration, each of the plurality of legs extends beyond a respective side of the desktop.

In a ninth aspect of the present disclosure, which may be combined with any other aspect listed herein unless specified otherwise, the desktop is a rectangular shape having a length and a width, the length being longer than the width.

In a tenth aspect of the present disclosure, which may be combined with any other aspect listed herein unless specified otherwise, each of the plurality of legs includes a support base, extending from a lower end of each of the plurality of legs and contacting a ground surface.

In an eleventh aspect of the present disclosure, which may be combined with any other aspect listed herein unless specified otherwise, each support base includes two integrated wheels.

In a twelfth aspect of the present disclosure, which may be combined with any other aspect listed herein unless specified otherwise, the collapsible desk further includes a retractable arm coupled to the support frame.

In a thirteenth aspect of the present disclosure, which may be combined with any other aspect listed herein unless specified otherwise, the collapsible desk further includes a control panel configured for electrical communication with the actuator.

In a fourteenth aspect of the present disclosure, which may be combined with any other aspect listed herein unless specified otherwise, a collapsible desk includes a desktop, a support frame disposed underneath the desktop, a first leg, a second leg, a first actuator, and a second actuator. The first leg is slidably coupled to the support frame. The second leg is slidably coupled to the support frame. The first actuator is coupled to one of the support frame and the desktop, and coupled to the first leg. The second actuator is coupled to one of the support frame and the desktop, and coupled to the second leg. The first actuator and the second actuator are configured to raise and lower the desktop.

In a fifteenth aspect of the present disclosure, which may be combined with any other aspect listed herein unless specified otherwise, the first leg and the second leg are pivotally coupled to one another via a scissor joint.

In a sixteenth aspect of the present disclosure, which may be combined with any other aspect listed herein unless specified otherwise, each of the first leg and the second leg includes a straight portion and a bent portion, the bent portion located at an upper end of each of the first leg and the second leg.

In a seventeenth aspect of the present disclosure, which may be combined with any other aspect listed herein unless specified otherwise, the upper end of each of the first leg and the second leg is configured to translate laterally within the support frame.

In an eighteenth aspect of the present disclosure, which may be combined with any other aspect listed herein unless specified otherwise, each of the first leg and the second leg includes a support base, extending from a lower end of each of the first leg and the second leg and contacting a ground surface.

In a nineteenth aspect of the present disclosure, which may be combined with any other aspect listed herein unless specified otherwise, at least one support base includes two integrated wheels.

In a twentieth aspect of the present disclosure, which may be combined with any other aspect listed herein unless specified otherwise, the collapsible desk further includes a control panel configured for electrical communication with the first actuator and the second actuator.

Additional features and advantages of the disclosed devices, systems, and methods are described in, and will be apparent from, the following Detailed Description and the Figures. The features and advantages described herein are not all-inclusive and, in particular, many additional features and advantages will be apparent to one of ordinary skill in the art in view of the figures and description. Also, any particular embodiment does not have to have all of the advantages listed herein. Moreover, it should be noted that the language used in the specification has been selected for readability and instructional purposes, and not to limit the scope of the inventive subject matter.

BRIEF DESCRIPTION OF THE FIGURES

Understanding that figures depict only typical embodiments of the invention and are not to be considered to be limiting the scope of the present disclosure, the present disclosure is described and explained with additional specificity and detail through the use of the accompanying figures. The figures are listed below.

DETAILED DESCRIPTION

It should be understood at the outset that, although illustrative implementations of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Figure 1:
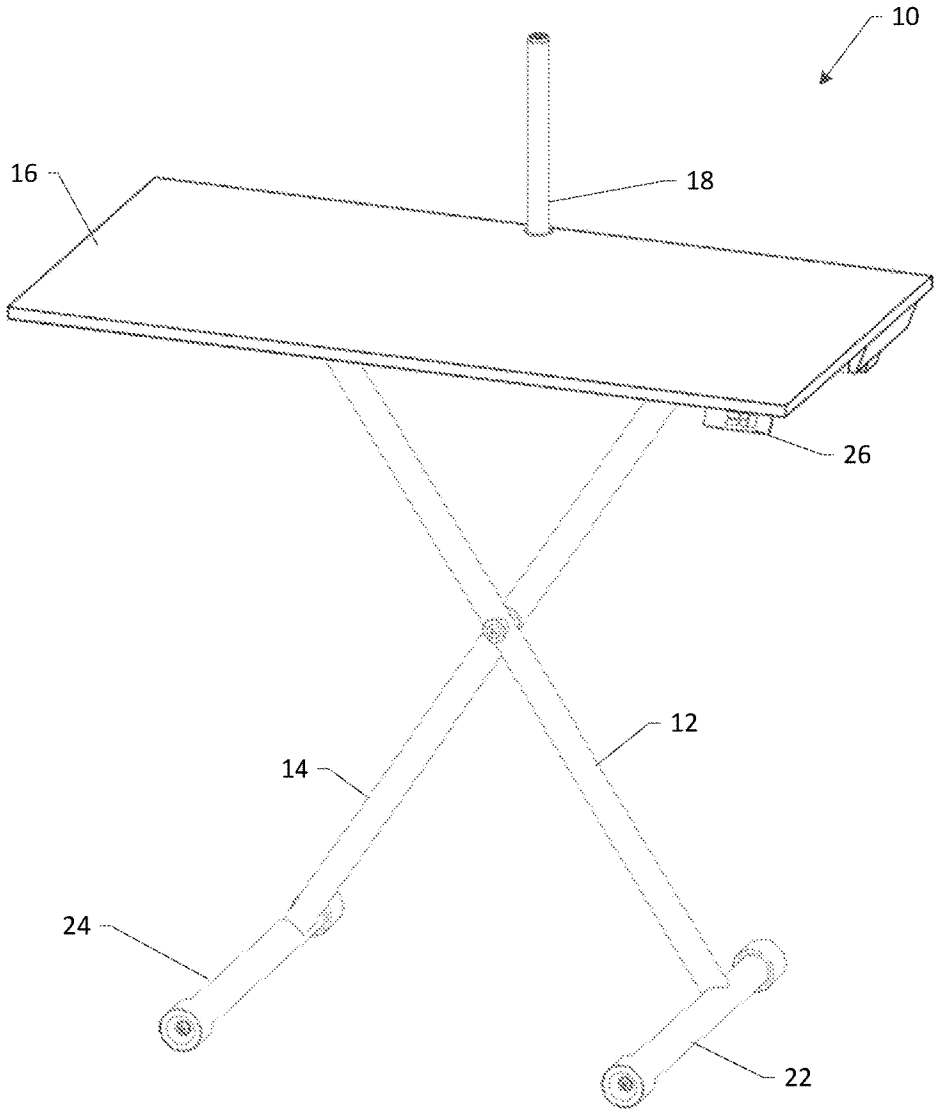
FIG. 1 illustrates a top perspective view of a collapsible height-adjustable desk along with integrated wheels, adjusted to a standing height, according to an example embodiment of the present disclosure.

FIG. 1 illustrates a top perspective view of a desk 10, adjusted to a standing height. As generally discussed herein, desk 10 may have a number of different height options, such as standing height, such as 47 inches (e.g., for use while a user is standing), sitting height, such as 30 inches (e.g., for use while a user is sitting in a chair), and storage height, such as 6 inches (e.g., for storage when desk 10 is not in use). While these three height options are discussed generally herein, it should be appreciated that a number of other heights (e.g., between these three options) are likewise contemplated.

FIG. 1 depicts an assembled, collapsible height-adjustable standing/sitting desk 10, also referred to as a desk 10 herein. Specifically, FIG. 1 shows one example of the desk 10 with two support legs 12, 14 positioned to a standing height. The illustrated desk 10 includes a desktop 16, which is typically a flat working space for the user. Desktop 16 is generally supported by the support legs 12, 14. The desk 10 may further include an integrated monitor arm 18, coupled to both the desk 10 (as described in greater detail herein) and coupled to an external monitor, a laptop, a tablet, a television, or any other related electronic device.

Generally speaking, the support legs 12, 14 are coupled to opposite ends of desktop 16, underneath desktop 16. Each of the support legs 12, 14 (described in greater detail herein) extends below the desktop 16 toward the ground in a scissor configuration; the support legs 12, 14 are pivotally coupled to one another. Moreover, each of the support legs 12, 14 includes a support base. For example, support leg 12 includes support base 22. Likewise, for example, support leg 14 includes support base 24. The support bases 22, 24 contact a ground surface, such as the floor. Each of the support bases 22, 24 extend in a direction orthogonal to the plane defined by support legs 12, 14. In an embodiment, each of the support legs 12, 14 and support bases 22, 24 are constructed of a single piece of material. For example, support leg 12 and support base 22 are constructed of the same piece of bent tubular material, such as tubular steel, which may advantageously reduce manufacturing costs for desk 10. In a different embodiment, each of support legs 12, 14 are single-piece bent tubular material, such as tubular steel; in this embodiment, each support leg 12, 14 is welded to its respective support base 22, 24 which is, likewise, a single-piece of tubular material such as tubular steel. In another different embodiment, each of support legs 12, 14 is a multi-component leg, having multiple segments that are coupled to one another (e.g., telescopically coupled, slidably coupled, threaded, or the like). In a related embodiment with multi-component legs, support legs 12, 14 may further include collapsible hinges.

Continuing on, each of support bases 22, 24 include a plurality of integrated wheels. For example, support base 22 includes two integrated wheels partially disposed within support base 22; support base 24, likewise, includes two integrated wheels partially disposed within support base 24. In an embodiment, the integrated wheels are disposed at the ends of support bases 22, 24. For example, each end of support bases 22, 24 may include bearings or sockets, configured to receive an axle of a respective integrated wheel. In an embodiment, support bases 22, 24 are capable of receiving removable wheels, such that integrated wheels may be easily added (or removed) by the user. In another embodiment, only one of support bases 22, 24 includes a plurality of integrated wheels. For example, support base 22 includes two integrated wheels and support base 24 includes no integrated wheels.

In an embodiment, desktop 16 is generally rectangular. It should be appreciated, however, that alternative geometric configurations are contemplated, such as squares, circles, ovals, and the like. Additionally, or alternatively, desktop 16 can include surface contouring, chamfering, filleting, and the like, such as for accommodating the torso of the user and/or accommodating monitor arms, cables, cords, and other related peripherals.

Desk 10, and particularly desktop 16, may further include additional user controls. For example, desktop 16 includes a plurality of user controls, such as integrated buttons 26, for powering desk 10 and raising and/or lowering desktop 16. Integrated buttons 26 may further include mode-selection (e.g., standing height, sitting height, storage height), along with power-on/off features. The user controls, particularly with respect to raising and/or lowering desktop 16, are described in greater detail herein. In an embodiment, desktop 16 further includes an integrated wireless charging pad, which may be used to charge external devices such as cell phones, tablets, and smart watches.

Figure 2:
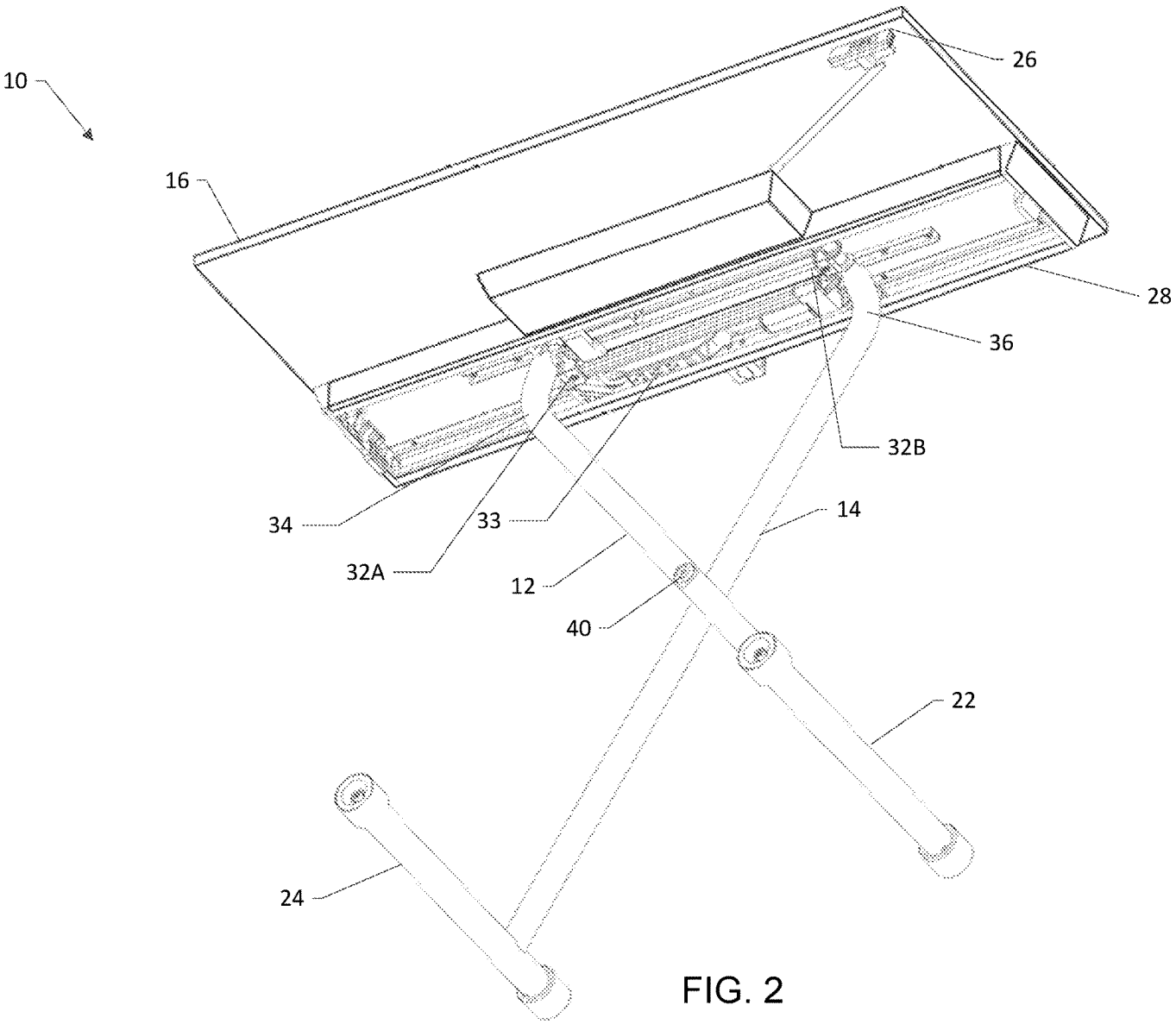
FIG. 2 illustrates a bottom perspective view of a collapsible height-adjustable desk along with integrated wheels, according to an example embodiment of the present disclosure.

FIG. 2 illustrates a bottom perspective view of desk 10. Desk 10 includes a frame 28 and two actuators, first actuator 32A and second actuator 32B disposed within the frame 28. In various embodiments, actuators 32A, 32B may be self-powered (such as via internal batteries) or alternatively be connected to an external power source (such as an electrical socket). While two actuators 32A, 32B are illustrated and described herein, it should be appreciated that one actuator may, alternatively, be used for reduced cost-savings. In an embodiment, each of the actuators 32A, 32B for desk 10 are electromechanical actuators. In alternative embodiment, actuators 32A, 32B are powered or operated via other energy sources, such as pneumatic gas lifts, mechanical hand cranks, lateral operating motors, belt-drives, chain-drives, or the like.

Specifically, actuator 32A is coupled to support leg 12, particularly at upper end 34 of support leg 12. Actuator 32B is coupled to support leg 14, particularly at upper end 36 of support leg 14. It should be appreciated that desk 10 may include intermediate mechanical features between, for example, support leg 12 and actuator 32A. For example, each support leg 12, 14 may include a cross bar at the respective upper end 34, 36, such that actuator 32A, 32B may be readily affixed to the cross bar of each support leg 12, 14.

In an embodiment, each of the support legs 12, 14, support bases 22, 24, and upper ends 34, 36 are constructed of a single piece of material. For example, support leg 12, support base 22, and upper end 34 are constructed of the same piece of bent tubular material, such as tubular steel. In a different embodiment, support leg 12 and upper end 34 is constructed of the same piece of bent tubular material, and is welded to support base 22. Generally, it should be appreciated that these features may, alternatively, be separate components that are coupled together. For example, desk 10 may include counterbalanced legs, such that a portion of material extends along the floor in each direction perpendicular to the scissor joint. In an embodiment, counterbalanced legs advantageously reduce risks associated with tipping over. Each of the counterbalanced legs further include integrated wheels (along the periphery or alternatively at the ends of the counterbalanced legs) for similar raising and lowering of desk 10 as disclosed herein.

Continuing on with FIG. 2, upper ends 34, 36 are configured to translate laterally, underneath desktop 16, along frame 28, such as two lateral rails. For example, each of upper ends 34, 36 are coupled to frame 28 such that upper ends 34, 36 can slidingly translate along frame 28. Furthermore, support legs 12, 14 are coupled to one another via pivot component 40, such that support legs 12, 14 are disposed in the scissor configuration.

Namely, the distance between upper ends 34, 36 is regulated, and modulated, via the actuators 32A, 32B, working in concert with one another. For example, actuator 32A can "pull" upper end 34 of support leg 12, to reduce the distance between upper end 34 of support leg 12 and a center of the desk 10; similarly, for example, actuator 32B can "pull" upper end 36 of support leg 14, to reduce the distance between upper end 36 of support leg 14 and the center of the desk 10. As this distance is reduced, upper ends 34, 36 are brought closer to one another, via actuators 32A, 32B; upper ends 34, 36 slide along frame 28 as they are brought closer to one another. Thus, as upper ends 34, 36 translate laterally within frame 28, legs 12, 14 pivot about pivot component 40, and support bases 22, 24 are brought closer together. The end result is that desktop 16 is "higher" off the ground. Similarly, as the distance between upper ends 34, 36 increased, upper ends 34, 36 are "pushed" further from one another, via actuators 32A, 32B. As upper ends 34, 36 translate laterally within frame 28, legs 12, 14 pivot about pivot component 40, and support bases 22, 24 are brought further from one another. The end result is that desktop 16 is "lower" to the ground.

Legs 12, 14 are geometrically designed for "raising" and "lowering" via actuators 32A, 32B. Namely, by having a bent portion at each of upper ends 34, 36, the actuators 32A, 32B can effectively "push/pull" the legs 12, 14 such that they slide within frame 28. Furthermore, the bent portion of upper ends 34, 36 ensures that the upper ends 34, 36 do not crush or interfere with actuators 32A, 32B, such as when legs 12, 14 are lowered to the storage configuration (illustrated generally by FIGS. 5 to 6 and 8). In an embodiment, each of actuators 32A, 32B has a stroke length of approximately 13.8 inches, yet has the ability to raise the desk a total of 42 inches (e.g., from 6 inches to 48 inches in height).

In an embodiment, frame 28 and/or upper ends 34, 36 include one or more springs, configured for urging upper ends 34, 36 in a particular direction. For example, a spring disposed between upper end 34 and upper end 36 may bias these components toward one another, such that the desk 10 is pre-disposed in a standing configuration; in this example, actuators 32A. 32B translate upper ends 34, 36 away from each other against the force of the spring.

As noted previously, desk 10 can be used in standing or sitting configurations, based on the height of desktop 16. In an embodiment, control of actuators 32A, 32B, for raising and lowering of desktop 16, may include communication with integrated buttons 26 (as noted above). For example, the user may select "up" or "down" via integrated buttons 26, such that actuators 32A, 32B raise or lower desktop 16. Similarly, for example, the user may select a particular mode (e.g., standing mode, sitting mode, storage mode), such that actuators 32A, 32B raise or lower desktop 16 to a predefined height. In another embodiment, control of actuators 32A, 32B, for raising and lowering of desktop, may include communication with external devices and/or applications, such as the user's smart phone. For example, the user may control actuators 32A, 32B via a smartphone in Bluetooth communication with the actuators 32A, 32B. In another embodiment, desk 10 includes an intermediary controller for receiving communications (e.g., from integrated buttons 26 and/or an external device) and sending communications (e.g., control communications to actuators 32A, 32B).

Desk 10 may further include an external outlet 33, disposed within frame 28. In an embodiment, the user can plug additional electronics, such as monitors, chargers, and the like, into external outlet 33. In an embodiment, external outlet 33 derives its power from the same power source as the actuators 32A, 32B (e.g., internal batteries or via an external power source).

Figure 3:
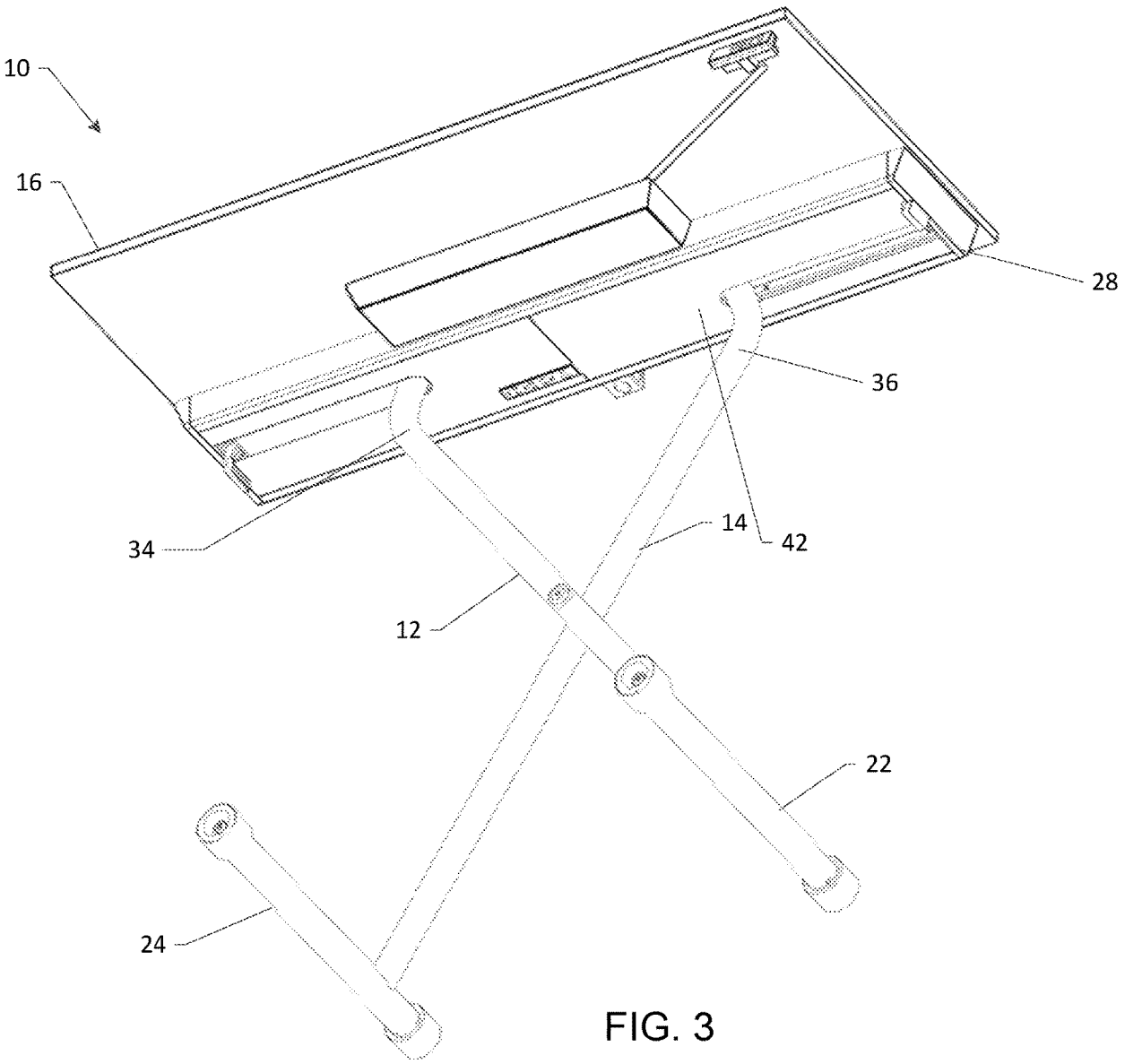
FIG. 3 illustrates a bottom perspective view of a collapsible height-adjustable desk along with integrated wheels and a protective cover, according to an example embodiment of the present disclosure.

FIG. 3 illustrates a bottom perspective view of desk 10 with a protective cover 42. For example, protective cover 42 may snap, slide, zip, attach with hook-and-loop fasteners, or otherwise be affixed within frame 28, to protect the user from moving parts such as actuators 32A, 32B, crossbars, springs, and other related moving parts, and thus improve overall safety. In an embodiment, protective cover 42 is a telescoping cover, such that it slides within frame 28 as the desktop 16 is raised or lowered.

Figure 4:
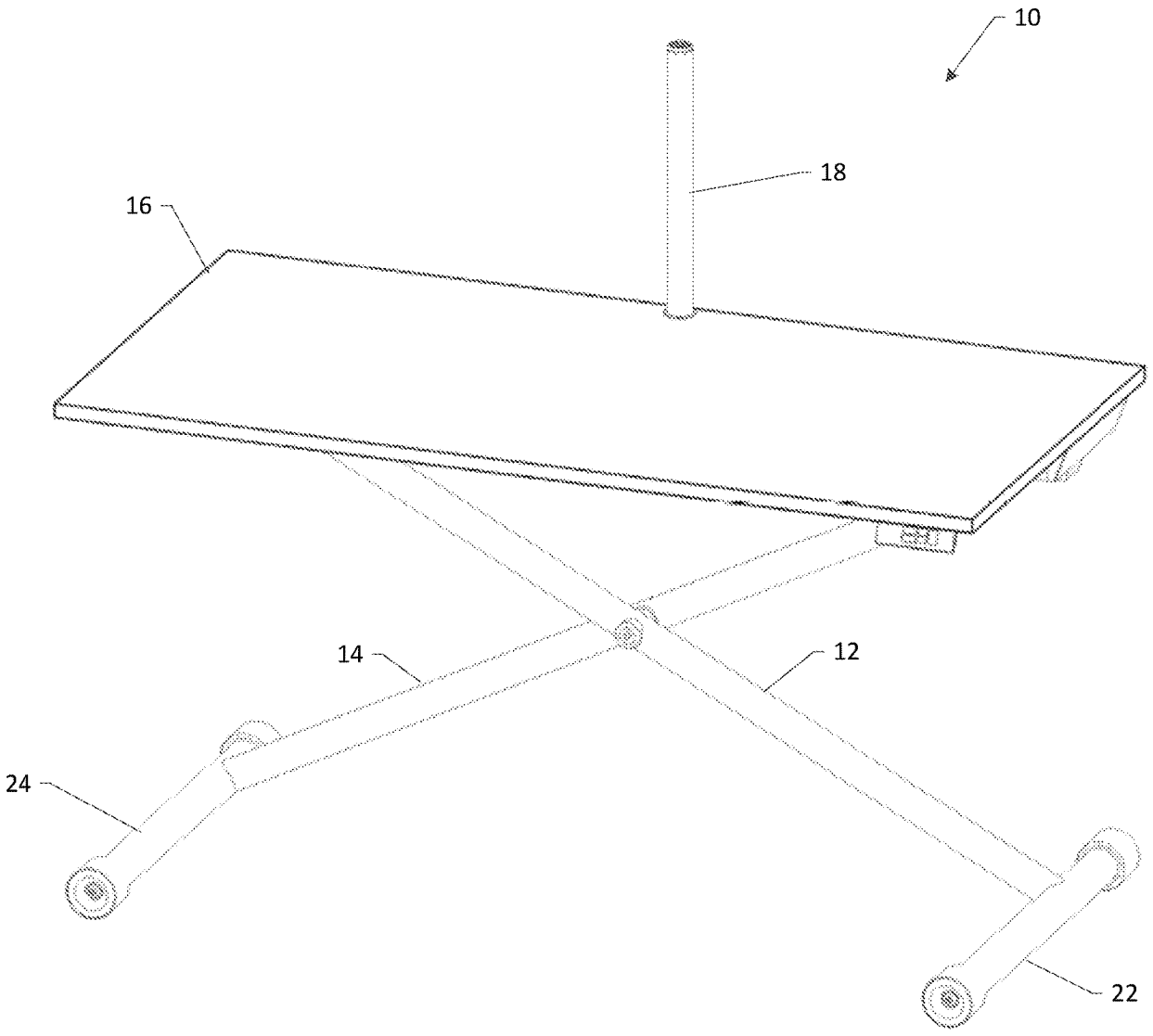
FIG. 4 illustrates a top perspective view of a collapsible height-adjustable desk along with integrated wheels, adjusted to a sitting height, according to an example embodiment of the present disclosure.

FIG. 4 illustrates a top perspective view of desk 10, adjusted to a sitting height. Namely, via the adjustment paradigm disclosed herein, the user is able to lower desk from a standing height (e.g., illustrated by FIG. 1) to a sitting height (e.g., illustrated by FIG. 4). Specifically, with comparison to FIG. 1, the desktop 16 in FIG. 4 is lower to the ground. Likewise, with comparison to FIG. 1, the support bases 22, 24 in FIG. 4 are further from one another. Generally, as support bases 22, 24 move closer or farther apart, during lifting and lowering of desktop 16, each of support base 22 and support base 24 slides along the ground via the integrated wheels, so as to avoid scratching of the surface of the floor. In an embodiment, the diameters of the integrated wheels are larger than the diameters of support bases 22, 24, to eliminate a pinch-point when a user is manually lowering one of support bases 22, 24 to the ground.

Figure 5:
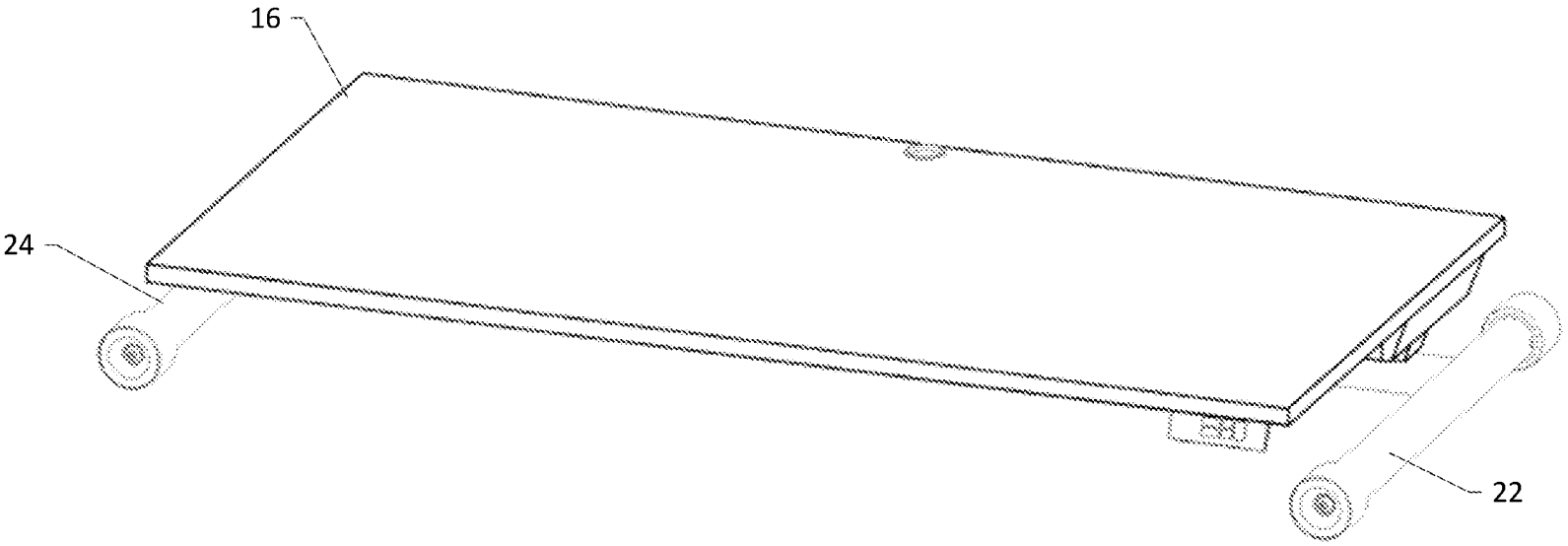
FIG. 5 illustrates a top perspective view of a collapsible height-adjustable desk along with integrated wheels, adjusted to a storage height, according to an example embodiment of the present disclosure.

FIG. 5 illustrates a top perspective view of desk 10, adjusted to a storage height. Namely, via the adjustment paradigm disclosed herein, the user is able to lower desk from a sitting height (e.g., illustrated by FIG. 4) to a storage height (e.g., illustrated by FIG. 5). Specifically, with comparison to FIG. 4, the desktop 16 in FIG. 5 is lower to the ground. In fact, the desktop 16 in FIG. 5 is illustrated at its "lowest" possible height. Likewise, with comparison to FIG. 4, the support bases 22, 24 in FIG. 5 are further from one another. In fact, the support bases 22, 24 in FIG. 5 are illustrated at their "furthest" point from one another. When the desk 10 is adjusted to storage height, it is well suited to be wheeled, slid, or shuffled into a storage location. Via support bases 22, 24 (and the related integrated wheels), a user may easily transport desk 10 to a storage location, without bearing the load of the desk 10.

Figure 6:
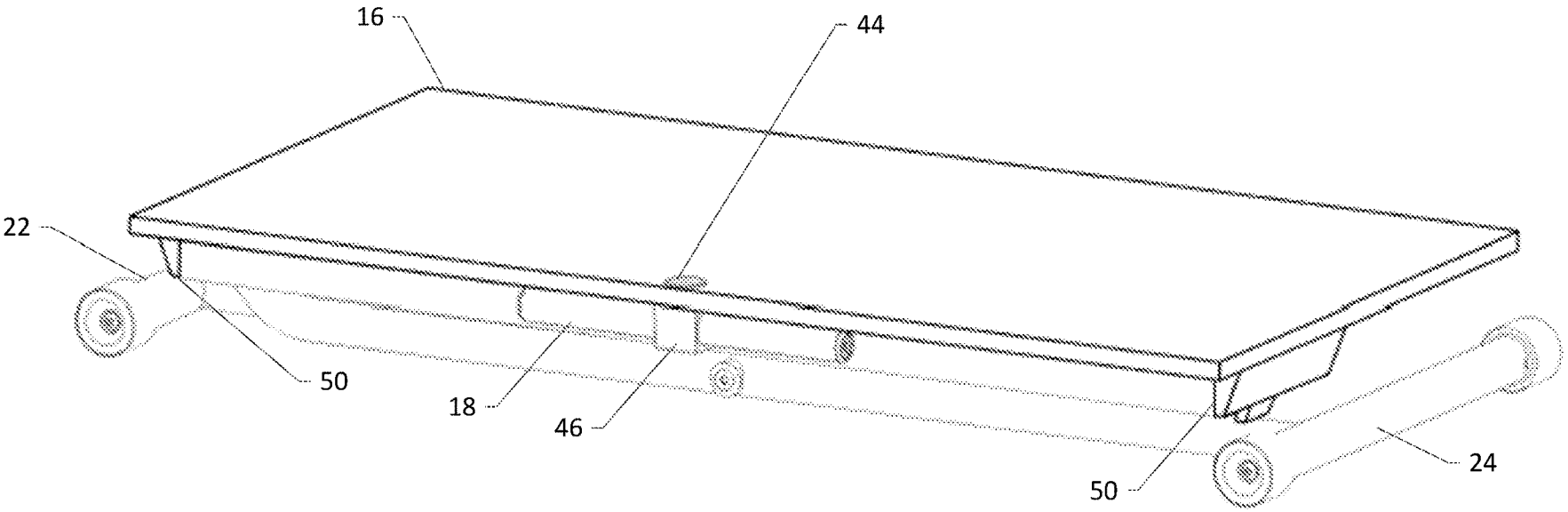
FIG. 6 illustrates a different top perspective view of a collapsible height-adjustable desk along with integrated wheels, adjusted to a storage height, according to an example embodiment of the present disclosure.

FIG. 6 illustrates a rear view of the desk 10 illustrated in FIG. 5. Specifically, desk 10 is illustrated with monitor arm 18 in a stored position. In an embodiment, desktop 16 includes a cavity 44, configured to receive monitor arm 18. For example, cavity 44 can be a threaded cavity, a cavity with a snap or locking feature, or a cavity with any other mechanical aspects for "locking" or "clamping" monitor arm 18 when monitor arm 18 is inserted into cavity 44. When monitor arm 18 is being used, it is "locked" or "clamped" into cavity 44. It should also be appreciated that monitor arm 18 may include additional features, such as a mounting bracket or multiple brackets for supporting more than one (e.g., two) monitors simultaneously. Furthermore, when monitor arm 18 is not being used, such as when desk 10 is in its storage height, monitor arm 18 can be coupled to latch 46 for efficient storage underneath desktop 16. In an embodiment, monitor arm 18 may alternatively be stored via a separate component from latch 46, such as a snap mount, rubber clip, bracket, or properly sized sleeve.

FIG. 6 further illustrates that desk 10 may include one or more frame end caps 50. For example, frame end caps 50 may be disposed underneath desktop 16, such as along a left and right edge of desktop 16. In an embodiment, frame end caps 50 are configured to prevent the desk 10 from lowering beyond its "lowest" possible height. Advantageously, frame end caps 50 prevent possible pinching (e.g., a foot of a user) and/or prevent undesirable mechanical results, such as over-extension of the stroke length of actuators 32A, 32B. Frame end caps 50 further prevent over-loading to desk 10 when in the stored configuration. For example, if a user steps on desktop 16, this vertical loading is transferred to frame end caps 50 (as opposed to legs 12, 14 and/or actuators 32A, 32B).

Figure 7B:
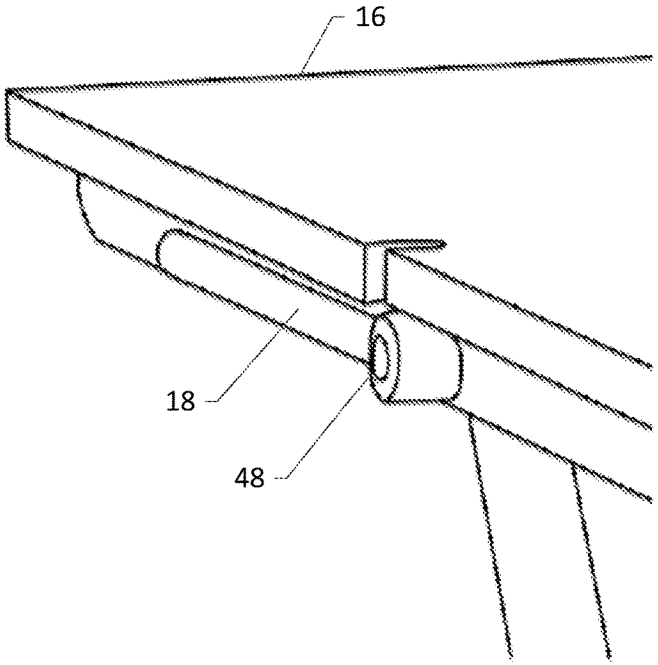
FIGS. 7A to 7B illustrate perspective views of an integrated monitor arm adjusted to the stored position, according to an example embodiment of the present disclosure.
Figure 7A:
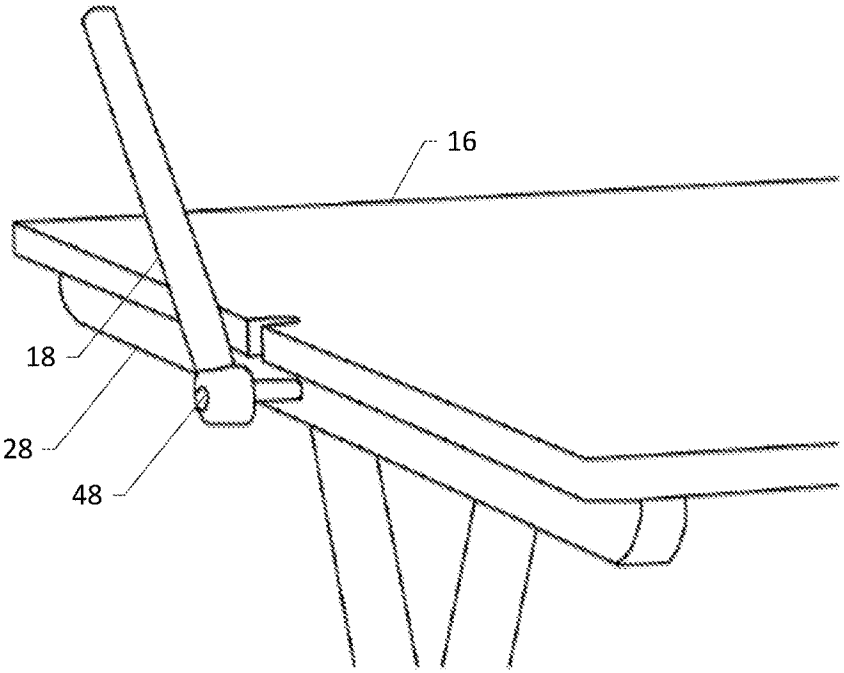

FIGS. 7A to 7B illustrate perspective views of an alternative integrated monitor arm 18. In this alternative embodiment, monitor arm 18 is pivotally coupled to the frame 28 of desk 10, underneath desktop 16, via joint 48. As illustrated, when in the vertical configuration, monitor arm 18 extends through a cutout in desktop 16. Joint 48 may include one or more features, such as a depressible lock/unlock mechanism, a spring, or a pressure clamp. Namely, when in a "locked" configuration, monitor arm 18 is unable to pivot about joint 48, without specific and intentional "unlocking" by the user. This ensures that the monitor is stable when coupled to monitor arm 18.

Monitor arm 18 may be moved from the vertical position to a stored position. For example, the user may depress the lock/unlock mechanism at joint 48, so that monitor arm 18 is in an "unlocked" configuration. Once unlocked, monitor arm 18 is able to translate outward (e.g., away from the cutout in desktop 16) and is further able to pivot about joint 48, from a vertical position to a horizontal storage position. When monitor arm 18 is disposed in the fully horizontal storage position, it then translates inward (e.g., under desktop 16). Once in this stored configuration, the user may depress the lock/unlock mechanism at joint 4, so that monitor arm 18 is in a "locked" configuration, underneath desktop 16.

Figure 8:
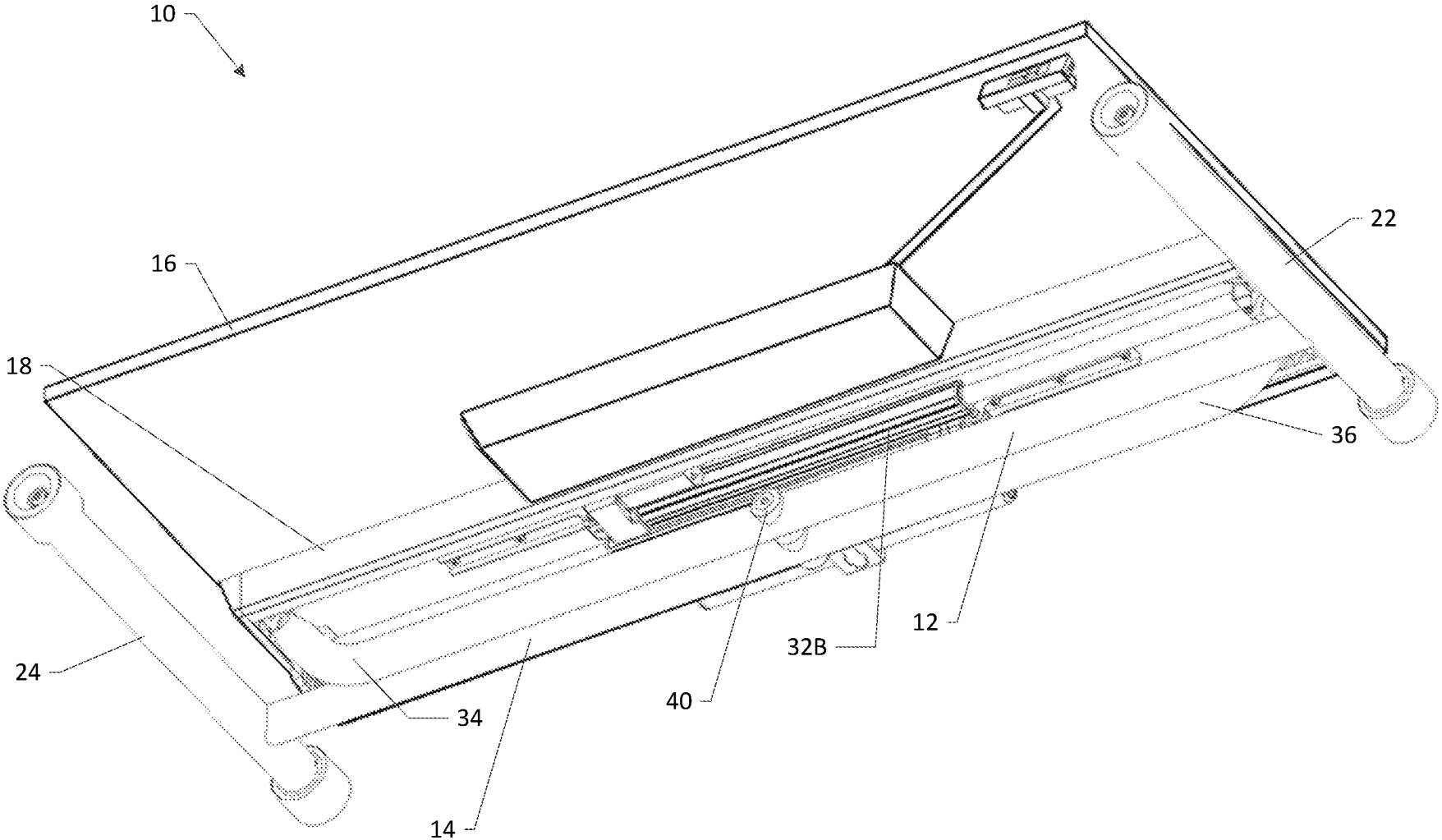
FIG. 8 illustrates a bottom perspective view of a collapsible height-adjustable desk along with integrated wheels, adjusted to a storage height, according to an example embodiment of the present disclosure.

FIG. 8 illustrates a bottom view of desk 10, adjusted to the storage height. In this storage configuration, support legs 12, 14 are generally parallel with desktop 16. Support legs 12, 14 are generally parallel with desktop 16 specifically because of the bent portion of upper ends 34, 36. These bent portions of upper ends 34, 36 further ensure that the upper ends 34, 36 do not crush or interfere with actuators 32A, 32B, such as when legs 12, 14 are lowered to the storage configuration. The bent portions of upper ends 34, 36 allow for desk 10 to be raised from storage configuration to sitting/standing configuration in a safe manner. The bent portions permit legs 12, 14 to lift in unison, as actuators 32A, 32B are engaged. These bent portions are geometrically optimized, to ensure that the lift forces derived from actuators 32A, 32B do not counter-act one another, but rather work in unison. In an embodiment, as illustrated by FIG. 8, the bent portions of upper ends 34, 36 of legs 12, 14 are antler-shaped or horn-shaped. In a different embodiment, the entire leg 12, 14 is a gradual bend (e.g., bent from support base 22, 24 to desktop 16); for example, in this different embodiment, the entire leg 12, 14 is curved.

Furthermore, in this storage configuration, each of the support bases 22, 24 extend beyond the side ends of desktop 16. Thus, the user can readily grab one of support bases 22, 24 to lift desk 10 and pivot it about integrated wheels. In an embodiment, the user can readily grab a handle for desk 10, as discussed in greater detail below.

Figure 9:
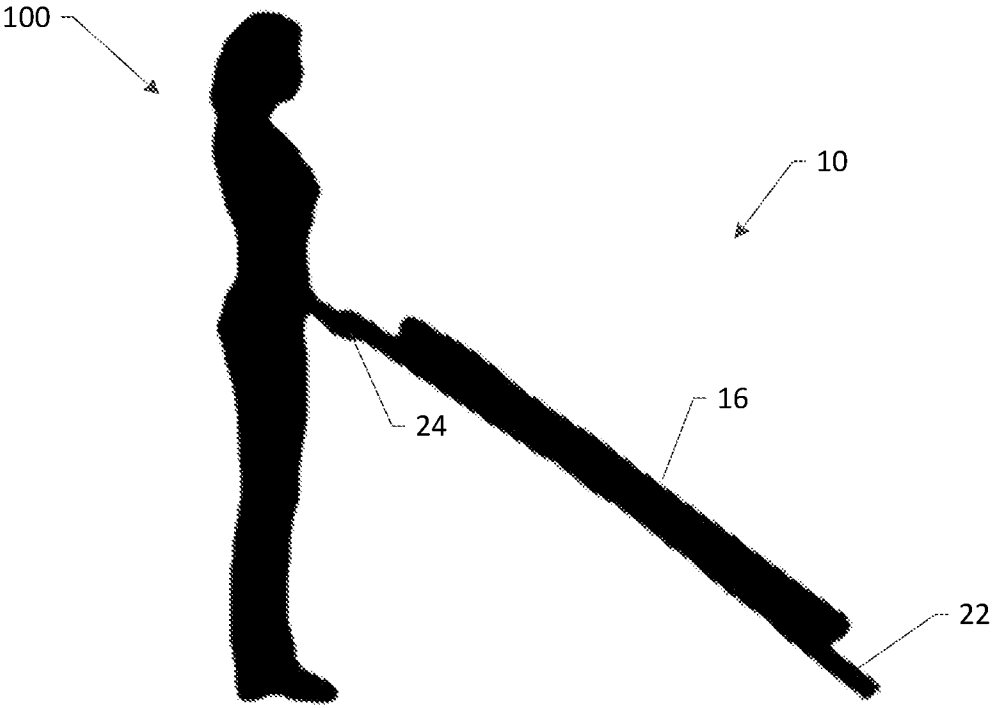
FIG. 9 illustrates a side view of a collapsible height-adjustable desk being moved by a user, according to the various embodiments described herein.

FIG. 9 illustrates a side view of desk 10 being moved by a user 100. Specifically, the user 100 can grasp either support base 22, support base 24, or desktop 16 to lift, pivot, steer, control, and push the desk to a different location and/or a storage location. For example, once desktop 16 is lowered to the storage configuration, user lifts desk 10 via support base 24; desk 10 pivots about the integrated wheels disposed on support base 22. Desk 10 may be transported to a storage location, such as leaned up against a wall or slid underneath a bed or other piece of furniture. Alternatively, desk 10 may be moved to a different location, and then "raised" via actuator 32 to either a standing or sitting configuration. Additionally or alternatively, desk 10 may include one or more handles disposed on support base 22, support base 24, or along one or more edges of desktop 16; for example, the handles may assist a user in lifting, steering, controlling, and pushing the desk 10 during transportation.

While several embodiments have been provided in the present disclosure, it may be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

As used in this specification, including the claims, the term "and/or" is a conjunction that is either inclusive or exclusive. Accordingly, the term "and/or" either signifies the presence of two or more things in a group or signifies that one selection may be made from a group of alternatives. As used here, "at least one of," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

Without further elaboration, it is believed that one skilled in the art can use the preceding description to utilize the claimed inventions to their fullest extent. The examples and embodiments disclosed herein are to be construed as merely illustrative and not a limitation of the scope of the present disclosure in any way. It will be apparent to those having skill in the art that changes may be made to the details of the above-described embodiments without departing from the underlying principles discussed. In other words, various modifications and improvements of the embodiments specifically disclosed in the description above are within the scope of the appended claims. For example, any suitable combination of features of the various embodiments described is contemplated.

Note that elements recited in means-plus-function format are intended to be construed in accordance with 35 U.S.C. § 112 ¶6. The scope of the invention is therefore defined by the following claims.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and may be made without departing from the spirit and scope disclosed herein.

The invention is claimed as follows:

1. A collapsible desk, comprising:

a desktop;

a support frame, disposed underneath the desktop;

a first leg coupled to the support frame;

a second leg coupled to the support frame, wherein at least one of the first leg or the second leg includes a plurality of integrated wheels;

wherein each of the first leg and the second leg includes a straight portion and a bent portion, the bent portion located at an upper end of each of the first leg and the second leg, wherein the bent portion of the first leg is affixed to the support frame and laterally translates within the support frame, and wherein the bent portion of the second leg is affixed to the support frame and laterally translates within the support frame; and an actuator, disposed within the support frame between the bent portion of the first leg and the bent portion of the second leg and coupled to one or more of the first leg and the second leg, wherein the actuator is configured to raise and lower the desktop, wherein, when the collapsible desk is lowered to a storage configuration, the straight portion of each of the first leg and the second leg is parallel to both the desktop and a ground surface.

2. The collapsible desk of claim 1, wherein the first leg and the second leg are pivotally coupled to one another via a scissor joint.

3. The collapsible desk of claim 1, wherein, responsive to the upper end of the first leg and the second leg translating laterally within the support frame, the first leg and the second leg pivot about a pivot component.

4. The collapsible desk of claim 3, wherein, responsive to the upper ends of the first leg and the second leg translating laterally towards each other within the support frame, the desktop is raised.

5. The collapsible desk of claim 3, wherein, responsive to the upper ends of the first leg and the second leg translating laterally away from each other within the support frame, the desktop is lowered.

6. The collapsible desk of claim 1, wherein, when the collapsible desk is lowered to the storage configuration, each of the first leg and the second leg extends beyond a respective side of the desktop.

7. The collapsible desk of claim 1, wherein the desktop is a rectangular shape having a length and a width, the length being longer than the width.

8. The collapsible desk of claim 1, wherein each of the first leg and the second leg includes a support base, extending from a lower end of each of the first leg and the second leg and contacting a ground surface.

9. The collapsible desk of claim 8, wherein each support base includes two integrated wheels.

10. The collapsible desk of claim 1, further comprising a retractable arm coupled to the support frame.

11. The collapsible desk of claim 1, further comprising a control panel configured for electrical communication with the actuator.

12. A collapsible desk, comprising:

a desktop;

a support frame, disposed underneath the desktop;

a first leg;

a second leg, wherein each of the first leg and the second leg includes a straight portion and a bent portion, the bent portion located at an upper end of each of the first leg and the second leg, wherein the bent portion of the first leg is affixed to the support frame and laterally translates within the support frame, and wherein the bent portion of the second leg is affixed to the support frame and laterally translates within the support frame;

a first actuator, coupled to one of the support frame and the desktop, and coupled to the first leg at the bent portion of the first leg; and a second actuator, coupled to one of the support frame and the desktop, and coupled to the second leg at the bent portion of the second leg, such that the first actuator and the second actuator are configured to raise and lower the desktop, wherein the first actuator and the second actuator are disposed within the support frame between the bent portion of the first leg and the bent portion of the second leg, wherein, when the collapsible desk is lowered to a storage configuration, the straight portion of each of the first leg and the second leg are parallel to both the desktop and a ground surface.

13. The collapsible desk of claim 12, wherein the first leg and the second leg are pivotally coupled to one another via a scissor joint.

14. The collapsible desk of claim 12, wherein each of the first leg and the second leg includes a support base, extending from a lower end of each of the first leg and the second leg and contacting a ground surface.

15. The collapsible desk of claim 14, wherein at least one support base includes two integrated wheels.

16. The collapsible desk of claim 12, further comprising a control panel configured for electrical communication with the first actuator and the second actuator.

* * * * *